United States Patent [19]

Ogura et al.

[11] Patent Number: 4,985,309

[45] Date of Patent: Jan. 15, 1991

[54] ALLOYED STEEL POWDER FOR POWDER METALLURGY

[75] Inventors: Kuniaki Ogura; Junichi Oota; Teruyoshi Abe; Shigeaki Takajo, all of Chiba, Japan

[73] Assignee: Kawasaki Steel Corporation, Hyogo, Japan

[21] Appl. No.: 226,478

[22] Filed: Aug. 1, 1988

[30] Foreign Application Priority Data

Aug. 1, 1987 [JP] Japan ..... 62-193400

[51] Int. Cl.[5] ..... B22F 1/02

[52] U.S. Cl. ..... 428/570

[58] Field of Search ..... 75/251, 255; 428/570, 428/610

[56] References Cited

U.S. PATENT DOCUMENTS

| | | | |
|---|---|---|---|
| 2,646,456 | 7/1953 | Jacquier | 428/570 |
| 4,011,077 | 3/1977 | Kaufman | 75/251 |
| 4,048,608 | 7/1978 | Matty et al. | 75/251 |
| 4,069,044 | 1/1978 | Mocarski et al. | 75/251 |
| 4,266,974 | 5/1981 | Nitta et al. | 75/251 |
| 4,561,893 | 12/1985 | Takajo | 75/255 |
| 4,578,115 | 3/1986 | Harrington et al. | 428/570 |
| 4,643,765 | 2/1987 | Takajo | 75/255 |
| 4,799,955 | 1/1989 | McClellan | 75/255 |
| 4,818,567 | 4/1989 | Kemp et al. | 428/510 |

FOREIGN PATENT DOCUMENTS

| | | | |
|---|---|---|---|
| 56-38401 | 4/1981 | Japan | 75/251 |
| 59-215401 | 12/1984 | Japan . | |
| 2117409A | 10/1983 | United Kingdom | 428/570 |

*Primary Examiner*—John J. Zimmerman

*Attorney, Agent, or Firm*—Oliff & Berridge

[57] ABSTRACT

An alloyed steel powder for metallurgy is provided with a water-atomized alloyed steel powder wherein an alloy component, an oxide of which is difficult to be reduced with hydrogen in the production of the powder, has been prealloyed in a composition range not exerting a bad influence upon compressibility of the steel powder, and an alloy component or components easier to be reduced with hydrogen than the above alloy component, the said easily reducible alloy component or components being partially diffused and adhered in a powdered form to the particle surfaces of the water-atomized alloyed steel powder.

The composite powder of the invention has a coating layer of at least one element selected from nickel, copper, molybdenum and tungsten which is partially diffused and adhered in a powder form to the surface of a chromium containing prealloyed steel powder.

2 Claims, No Drawings

ALLOYED STEEL POWDER FOR POWDER METALLURGY

BACKGROUND OF THE INVENTION

1. Field of the Invention

The present invention relates to an alloyed steel powder for metallurgy, which powder is suitable for use in the preparation of a sintered product of high density and high strength.

2. Description of the Prior Art

With development of alloyed steel powders there has been a demand for higher characteristics of sintered parts and higher density and higher strength are now required for alloyed steel powders to attain higher loading on sintered products. Especially improvement of density is effective on improvement of fatigue properties and toughness.

The strength of a sintered compact of an alloyed steel powder is generally improved by increasing the amount of alloy. In the conventional prealloying process, however, the compressibility of steel powder is deteriorated with increase in the amount of alloy, and according to a conventional powder metallurgy of a single pressing—single sintering type, it is now very difficult to attain both high density and high strength partly because of demand for a higher level of density and of strength. The demand for higher density may be satisfied by utilizing such a sinter forging process as is disclosed in Japanese Patent Laid-Open No. 44104/86. But this process involves many restrictions in point of the life of mold and the shape of product. On the other hand, according to a double pressing process wherein a single sintering operation is followed by repressing in a mold, there are few restrictions in point of the life of mold and the shape of product because the repressing is performed in a cold state like the single pressing process and thus the double pressing process is a more practical process.

However, in order to attain a higher density by such double pressing process, it is necessary to use a steel powder which affords as high density as possible in the first pressing and affords a still higher density in the second pressing after sintering which follows the first pressing. Such a steel powder is required to satisfy the following conditions:

(1) Should be superior in compressibility.

(2) Generally, graphite powder is added at the time of sintering in order to enhance the strength of sintered steel. In this connection, in the first sintering which is performed usually at a lower temperature for a shorter time than in the second sintering, the steel powder should afford a sintered compact low in hardness and superior in recompressibility.

(3) By a heat treatment which follows the second pressing and sintering operation, the sintered compact should become sufficiently high in strength in order to obtain a finally required strength.

As alloyed steel powders for high strength there have been developed chromium-containing steel powders. For example, in Japanese Patent Laid-Open No. 164901/82 there is proposed a chromium-containing steel powder having enhanced compressibility and hardenability. In such alloyed steel powder, however, all the alloyed components, including chromium, are prealloyed, so where such alloy steel powder is applied to a double pressing process, graphite, which is added to improve the strength of the final sintered steel, easily dissolves into the steel powder as a sintered compact constituent at the time of the first temporary sintering, so that the steel powder hardens, thus leading to deteriorated recompressiblity.

In Japanese Patent Laid-Open No. 87202/83 there is proposed a method of diffusing and adhering chromium, in the form of a fine alloy powder with iron, to the steel powder surface. However, since an iron-chromium alloy usually contains a hard sigma phase, its direct use would cause wear of a mold at the time of powder molding. As means for solving this problem it may be effective to heat-treat the Fe-Cr alloy powder having a sigma phase into a soft alpha-phase compound for diffusion and adhesion to the steel powder surface. But there remains the problem that the steel powder manufacturing process becomes complicated.

Further, where chromium powder is to be diffused and adhered to the steel powder surface, since chromium has a strong affinity for oxygen, even if other alloy elements which are more easily reducible than chromium such as, for example, molybdenum and/or tungsten are to be diffused and adhered in the form of oxides to the steel powder surface together with chromium, chromium will be oxidized with the result that the function as the chromium alloy is no longer exhibited or the compressibility of the steel powder is deteriorated. Because of these problems, such method is not desirable.

SUMMARY OF THE INVENTION

The present invention solves the above-mentioned problems in an advantageous manner, more particularly, solves such problems as restrictions on the life of mold and the shape of product as well as low recompressiblity all involved in the conventional molding and sintering processes and alloyed steel powders. And it is the object of the invention to provide an alloyed steel powder for powder metallurgy capable of affording a sintered compact of high strength and high density suitable for use in a double pressing process.

Having made extensive studies for achieving the above-mentioned object, the present inventors found that the desired object could be attained in an extremely advantageous manner by:

(i) prealloying, out of elements to be alloyed, an element less deteriorating the compressibility of steel powder, affording high hardenability in a small amount, being difficult to be reduced with hydrogen in the form of an oxide, and by diffusive adhesion, being difficult to be composite-alloyed while maintaining compressibility;

(ii) on the other hand, partially diffusing and adhering an element to the surface of the prealloy obtained in the above (i) to effect composite-alloying, the said element being relatively easy to be reduced, easy to be composite-alloyed while maintaining compressibility by diffusive adhesion, being negative in affinity for carbon or forming a carbide positively to thereby suppress the diffusion of graphite into a sintered compact substrate during sintering at a low temperature, and capable of improving hardenability in a heat treatment after the second sintering.

The present invention is based on the above finding.

More specifically, the present invention is an alloyed steel powder for powder metallurgy, having a diffused coating layer of at least one element selected from nickel, copper, molybdenum and tungsten, the coating layer partially diffused and adhered in a powdered form to the surfaces of prealloyed steel powder particles containing chromium or chromium plus one or more elements selected from vanadium, niobium and boron, the contents of the components being as follows:

Cr: 0.1–5.0 wt. %
V: 0.01–0.5 wt. %
Nb: 0.001–0.01 wt. %
B: 0.0001–0.01 wt. %
Ni: 0.1–10.0 wt. %
Cu: 0.1–10.0 wt. %
Mo: 0.1–5.0 wt. %
W: 0.1–5.0 wt. % with the limitation that Ni+Cu+Mo+W is not more than 10.0 wt. %, the balance comprising not more than 0.20 wt. % of oxygen and a substantial amount of iron.

DESCRIPTION OF THE INVENTION

In the present invention, the contents of the alloy components are restricted to the aforementioned ranges. This is for the following reasons.

The prealloying and composite-alloying components used in the present invention have been selected in view of the functions required as noted previously. More specifically, the prealloying components should have little influence upon the compressibility of steel powder, can improve the hardenability of a sintered compact even in a small amount thereof added, and should be difficult to be composite-alloyed without imparing compressiblity by diffusive adhesion. As a component satisfying such requirements, chromium has been selected in the invention.

Chromium has a high hardenability, about twice that of nickel, so is used in the invention as a principal component for improving the strength of sintered steel. Further, prealloying it is extremely useful also in the following points.

(1) The uniformity of the sintered steel texture is improved, thus leading to improvement in strength and toughness.
(2) When chromium is prealloyed into iron, its activity is reduced, so that the oxidation resistance is improved and it becomes possible to composite-alloying an oxide of an element which is more easily reducible than chromium.
(3) Since chromium improves hardenability in a small amount thereof used, the compressibility of steel powder is scarcely deteriorated.
(4) Chromium is less expensive and superior in economy as compared with nickel.

The upper limit of chromium to be added is here specified to be 5.0 wt. % in view of the upper limit of the amount of oxygen in steel powder after composite-alloying of an easily reducible oxide and compressibility of the steel powder. On the other hand, the lower limit thereof is here set to 0.1 wt. % at which there is obtained the aforementioned effect of the addition of chromium.

Further, vanadium, niobium and boron are here mentioned as elements to be alloyed, in addition to chromium, which are difficult to be composite-alloyed because of the difficulty of their oxides being reduced with hydrogen and which can enhance the function of chromium even in small amounts. After making various studies, the present inventors specified the amounts of those elements to be added as follows like ingot steel.

Vanadium is effective in improving hardenability. But if its amount used is smaller than 0.01 wt. %, it will be less effective, while an amount thereof exceeding 0.5 wt. % will result in deteriorated hardenability, so the amount of vanadium to be added should be in the range of 0.01 to 0.5 wt. %.

Niobium is effective in making crystal grain fine and contributes to obtaining a tough sintered steel. But if its amount is smaller than 0.001 wt. %, it will be less effective, while an amount thereof exceeding 0.1 wt. % will result in hardenability being markedly deteriorated by crystal grain refining, so the amount of niobium to be added should be in the range of 0.001 to 0.1 wt. %.

Boron is effective in improving the hardenability of sintered steel, but if its amount is smaller than 0.0001 wt. %, it will be less effective, while an amount thereof exceeding 0.01 wt. % will result in deteriorated toughness, so the amount thereof to be added should be in the range of 0.0001 to 0.01 wt. %.

The reason why nickel, copper, molybdenum and tungsten were selected as components to be composite-alloyed to the particle surfaces of the above prealloyed steel powder is as follows. These elements are all capable of being composite-alloyed without impairing compressibility by their diffusive adhesion to the steel powder particles.

More particularly, nickel not only improves the sinterability of iron powder but also is remarkably effective in improving the strength and toughness of sintered steel. Further, at the first low-temperature sintering stage, a large amount of nickel remains on the steel powder particle surfaces in an insufficiently diffused state, and because of its negative affinity for carbon, it prevents the diffusion of carbon into the steel powder which contains chromium, thereby preventing deterioration of recompressibility of the steel powder particles in a sintered compact caused by dissolving of carbon. However, if the amount of nickel is smaller than 0.1 wt. %, nickel will be less effective, while an excess amount thereof exceeding 10.0 wt. % will impede recompressibility, so the amount of nickel to be added should be in the range of 0.1 to 10.0 wt. %.

Copper has a similar effect to nickel and its quantitative range is decided like that of nickel. The value of 0.1 wt. % at which the effect of the addition of nickel is developed, and the value of 10.0 wt. % not impairing recompressibility, are defined to be lower and upper limits, respectively; that is, a quantitative range of copper is 0.1 to 10.0m wt. %.

Molybdenum improves the hardenability and toughness of sintered steel. At the first low-temperature sintering stage, a large amount of molybdenum remains on the steel powder particle surfaces in an insufficiently diffused state, and because of a strong affinity for carbon, molybdenum functions to capture carbon on the steel powder particle surfaces to prevent the diffusion of carbon into the steel powder which contains chromium, thereby preventing the deterioration of recompressiblity caused by dissolving of carbon into the sintered compact substrate. Further, when molybdenum is added in the form of an oxide, since the composite-alloying treatment is performed in a reducing atmosphere, the oxide is once evaporated and thereafter reduced, so that the surfaces of the steel powder particles are wholly coated in a uniform condition and hence the above carbon diffusion preventing ability is further enhanced.

However, if the amount of molybdenum added is smaller than 0.1 wt. %, the addition of molybdenum will be less effective, while if molybdenum is added in an excess amount exceeding 5.0 wt. %, it will impair recompressibility, so the amount of molybdenum to be added should be in the range of 0.1 to 5.0 wt. %.

Tungsten is also effective to about the same extent as molybdenum and it effectively contributes to enhancing the hardenability of sintered steel. Further, it is easy to obtain tungsten in the form of a fine metal powder or an oxide, so the use of tungsten in such a form is advantageous in that it improves the recompressibility of sintered steel under the same action as that of molybdenum. But if the amount of tungsten added is less than 0.1 wt. %, the effect of its addition will be poor, while an amount thereof added exceeds 5.0 wt. % will impair recompressibility, so the amount of tungsten to be added should be in the range of 0.1 to 5.0 wt. %.

Even when nickel, copper, molybdenum and tungsten are used each independently, they each function to improve the characteristics of the sintered steel obtained. But this function will be further enhanced if one or more of them are used in combination. However, a too large amount would cause reaction between components of the composite in the production of steel powder, leading to deteriorated compressibility. So it is important that the total amount thereof (Ni+Cu+Mo+W) should be not larger than 10.1 wt. %.

Oxygen in the steel powder acts to lower the compressibility of the same powder, so it is desirable to minimize its incorporation. An amount thereof not larger than 0.20% is allowable.

EXAMPLES

Water-atomized steel powders each containing chromium in the range of 0.2 to 4.5 wt. % and water-atomized steel powders each containing 0.2–4.5 wt. % Cr plus at least one of 0–0.3 wt. % V, 0–0.03 wt. % Nb, 0–0.003 wt. % B and 0.6 wt. C were each annealed at 1,050° C. in a reduced pressure atmosphere of 1 Torr for 60 minutes to have the oxide on the surfaces of the water-atomized steel powder particles removed by reduction with the carbon in the steel powder, followed by disintegrating and screening operations used in the ordinary steel powder production for powder metallurgy, to obtain various chromium-containing steel powders. The steel powders thus obtained were superior in compressibility, with small amounts of oxygen, nitrogen and carbon remaining in the powders.

Then, nickel and copper powders were incorporated in combination into the steel powders in such amounts as to give nickel and contents in the final steel powders each in the range of 0 to 9.5 wt. %; also, molybdenum oxide and tungsten oxide powders were incorporated in combination into the steel powders in such amounts as to give molybdenum and tungsten contents in the final steel powders each in the range of 0 to 4.5 wt. %, followed by heating at 800° C. in a hydrogen gas atmosphere at 800° C. for 60 minutes to effect composite-alloying of Ni, Cu, Mo and W.

After such composite-alloying treatment, the foregoing disintegrating and screening operations were performed to obtain various compositions as Examples 1 to 25.

Thereafter, 0.4 wt. % of graphite powder for powder metallurgy and 1 wt. % of zinc stearate as a solid lubricant were mixed with each of the steel powders of Examples 1–25, followed by compacting at a pressure of 7 t/cm$^2$ into tablets each 11.3 mm in diameter and 10.5 mm in height. The green compacts thus obtained were then subjected to a temporary sintering at 875° C. in an atmosphere for 20 minutes. The thus temporarily sintered compact was recompressed at a pressure of 7 t/cm$^2$ according to a mold lubrication method and then subjected to a regular sintering at 1,250° C. in an atmosphere for 60 minutes. A heat treatment was thereafter performed by heating at 850° C. for austenitization to take place, quenching from that temperature into a 60° C. oil and subsequent tempering at 180° C. in oil.

Table 1 shows the results of having measured the amount of oxygen in the steel powder, compressed density, recompressed density and deflective strength of the heat-treated compact with respect to each of Examples 1–4.

TABLE 1

| Symbol | Amount of Alloy (%) Cr | V | Nb | B | Ni | Mo | W | Amount of Oxygen in Steel Powder (%) | Green Density (g/cm$^3$) | Recompressed Density* (g/cm$^3$) | Transverse rupture Strength of Heat-treated Compact** (kgf/mm$^2$) |
|---|---|---|---|---|---|---|---|---|---|---|---|
| Example 1 | 0.2 | — | — | — | — | 4.5 | — | 0.05 | 7.20 | 7.60 | 185 |
| Example 2 | 2.5 | — | — | — | — | 4.5 | — | 0.10 | 7.12 | 7.50 | 220 |
| Example 3 | 4.5 | — | — | — | — | 4.5 | — | 0.19 | 7.06 | 7.42 | 255 |
| Example 4 | 4.5 | — | — | — | 2.5 | 3.5 | 2.5 | 0.19 | 7.05 | 7.44 | 265 |
| Comparative Example 1 | 0.05 | — | — | — | — | 4.5 | — | 0.03 | 7.18 | 7.60 | 155 |
| Comparative Example 2 | 7.5 | — | — | — | — | 4.5 | — | 0.28 | 6.96 | 7.30 | 230 |
| Comparative Example 3 | 4.5 | — | — | — | 4.5 | 4.5 | 2.5 | 0.19 | 6.97 | 7.38 | 260 |

*Compacting . . . zinc stearate 1%, graphite 0.4%, Compacting pressure 7 t/cm$^2$.
Temporary sintering . . . 875° C. × 20 min, Mold lubrication, Recompression pressure 7 t/cm$^2$.
**Regular Sintering . . . 1,250° C. × 60 min, Heat treatment: tempering in oil at 180° C. × 90 min after quenching from 850° C. into 60° C. oil.

In all of Examples 1 to 3 according to the present invention there were obtained green densities above 7.00 g/cm$^3$, recompressed densities above 7.40 g/cm$^3$ and transverse rupture strengths above 170 kgf/mm$^2$.

Tables 2 and 3 show the results of having measured recompressed densities of the steel powders of Examples 5 to 9. In all of them there were attained recompressed densities above 7.40 g/cm$^3$ because the Cr, Mo and W contents satisfied the respective ranges specified herein.

TABLE 2

| Symbol | Amount of Alloy (%) Cr | V | Nb | B | Ni | Mo | W | Amount of Oxygen in Steel Powder (%) | Recompressed Density* (g/cm³) | Transverse rupture Strength of Heat-treated Compact** (kgf/mm²) | Alloying Method |
|---|---|---|---|---|---|---|---|---|---|---|---|
| Example 5 | 4.5 | — | — | — | — | 0.2 | — | — | 7.45 | — | — |
| Example 6 | 4.5 | — | — | — | — | 2.5 | — | — | 7.43 | — | — |
| Example 4 | 4.5 | — | — | — | — | 4.5 | — | — | 7.42 | — | — |
| Comparative Example 4 | 4.5 | — | — | — | — | 0.05 | — | — | 7.37 | — | — |
| Comparative Example 5 | 4.5 | — | — | — | — | 7.5 | — | — | 7.36 | — | — |

*Compacting . . . zinc stearate 1%, graphite 0.4%, Compacting pressure 7 t/cm².
Temporary Sintering . . . 875° C. × 20 min, Mold lubrication, Recompression pressure 7 t/cm².
**Regular Sintering . . . 1,250° C. × 60 min, Heat treatment: tempering in oil at 180° C. × 90 min after quenching from 850° C. into 60° C. oil.

TABLE 3

| Symbol | Amount of Alloy (%) Cr | V | Nb | B | Ni | Mo | W | Amount of Oxygen in Steel Powder (%) | Recompressed Density* (g/cm³) | Transverse rupture Strength of Heat-treated Compact** (kgf/mm²) | Alloying Method |
|---|---|---|---|---|---|---|---|---|---|---|---|
| Example 7 | 4.5 | — | — | — | — | — | 0.2 | — | 7.45 | — | — |
| Example 8 | 4.5 | — | — | — | — | — | 2.5 | — | 7.44 | — | — |
| Example 9 | 4.5 | — | — | — | — | — | 4.5 | — | 7.43 | — | — |
| Comparative Example 6 | 4.5 | — | — | — | — | — | 0.05 | — | 7.35 | — | — |
| Comparative Example 7 | 4.5 | — | — | — | — | — | 7.5 | — | 7.35 | — | — |

*Compacting . . . zinc stearate 1%, graphite 0.4%, Compacting pressure 7 t/cm².
Temporary Sintering . . . 875° C. × 20 min, Mold lubrication, Recompression pressure 7 t/cm².
**Regular Sintering . . . 1,250° C. × 60 min, Heat treatment: tempering in oil at 180° C. × 90 min after quenching from 850° C. into 60° C. oil.

Table 4 shows recompressed densities of the steel powders used in Examples 10 to 12. In all of Examples 10 to 12 falling under the specified ranges of both Cr and Ni contents, there were obtained recompressed densities above 7.40 g/cm³.

TABLE 4

| Symbol | Amount of Alloy (%) Cr | V | Nb | B | Ni | Mo | W | Amount of Oxygen in Steel Powder (%) | Recompressed Density* (g/cm³) | Transverse rupture Strength of Heat-treated Compact** (kgf/mm²) | Alloying Method |
|---|---|---|---|---|---|---|---|---|---|---|---|
| Example 10 | 4.5 | — | — | — | 0.2 | — | — | — | 7.44 | — | — |
| Example 11 | 4.5 | — | — | — | 5.0 | — | — | — | 7.44 | — | — |
| Example 12 | 4.5 | — | — | — | 9.5 | — | — | — | 7.43 | — | — |
| Comparative Example 8 | 4.5 | — | — | — | 0.05 | — | — | — | 7.38 | — | — |
| Comparative Example 9 | 4.5 | — | — | — | 12.0 | — | — | — | 7.39 | — | — |

*Compacting . . . zinc stearate 1%, graphite 0.4%, Compacting pressure 7 t/cm².
Temporary Sintering . . . 875° C. × 20 min, Mold lubrication, Recompression pressure 7 t/cm².
**Regular Sintering . . . 1,250° C. × 60 min, Heat treatment: tempering in oil at 180° C. × 90 min after quenching from 850° C. into 60° C. oil.

Table 5 shows recompressed densities of the steel powders used in Examples 13 to 25 and deflective strengths of heat-treated compacts

TABLE 5-(1)

| Symbol | Amount of Alloy (%) Cr | V | Nb | B | Ni | Mo | W | Amount of Oxygen in Steel Powder (%) | Recompressed Density* (g/cm³) | Transverse rupture Strength of Heat-treated Compact** (kgf/mm²) | Alloying method |
|---|---|---|---|---|---|---|---|---|---|---|---|
| Example 13 | 0.5 | — | — | — | 4.5 | 0.5 | — | — | 7.60 | — | — |
| Example 14 | 0.5 | — | 0.3 | — | — | 0.5 | — | — | 7.60 | 180 | — |
| Example 15 | 0.5 | — | — | 0.003 | 0.5 | — | — | — | 7.59 | 182 | — |
| Example 16 | 0.5 | 0.3 | — | — | 0.5 | — | — | — | 7.61 | 185 | — |
| Example 17 | 0.5 | 0.3 | 0.3 | 0.003 | 0.5 | 0.5 | — | — | 7.57 | — | — |
| Example 18 | 0.5 | 0.3 | — | — | 0.5 | — | 0.5 | — | 7.59 | — | — |
| Example 19 | 0.5 | 0.3 | 0.3 | 0.003 | 0.5 | 0.5 | 0.5 | — | 7.57 | — | — |

TABLE 5-(1)-continued

| Symbol | Amount of Alloy (%) Cr | V | Nb | B | Ni | Mo | W | Amount of Oxygen in Steel Powder (%) | Recompressed Density* (g/cm³) | Transverse rupture Strength of Heat-treated Compact** (kgf/mm²) | Alloying method |
|---|---|---|---|---|---|---|---|---|---|---|---|
| Example 20 | 0.5 | 0.3 | 0.3 | — | | 0.5 | 0.5 | — | 7.59 | — | — |
| Example 21 | 0.5 | — | — | — | 0.5 | — | — | — | 7.63 | — | — |
| Example 22 | 0.5 | — | 0.3 | 0.003 | — | 0.5 | 0.5 | — | 7.58 | — | — |
| Example 23 | 0.5 | 0.3 | — | 0.003 | — | 0.5 | 0.5 | — | 7.57 | — | — |
| Example 24 | 0.5 | — | — | — | 0.5 | 0.5 | 0.5 | — | 7.60 | — | — |
| Example 25 | 0.5 | — | | — | — | 0.5 | — | — | 7.61 | 175 | — |
| Example 26 | 0.5 | — | — | — | 0.5 | 0.5 | 0.5 | — | 7.58 | — | Composite-alloying of Ni, Mo, and W. |

TABLE 5-(2)

| Symbol | Amount of Alloy (%) Cr | V | Nb | B | Ni | Mo | W | Amount of Oxygen in Steel Powder (%) | Recompressed Density* (g/cm³) | Transverse rupture Strength of Heat-treated Compact** (kgf/mm²) | Alloying method |
|---|---|---|---|---|---|---|---|---|---|---|---|
| Comparative Example 10 | 0.5 | — | — | — | 0.5 | 0.5 | — | — | 7.37 | 144 | Prealloying of Cr, Ni and Mo |
| Comparative Example 11 | 0.5 | — | 0.2 | — | — | 0.5 | — | — | 7.58 | 113 | — |
| Comparative Example 12 | 0.5 | — | — | 0.02 | 0.5 | — | — | — | 7.50 | 110 | — |
| Comparative Example 13 | 0.5 | 0.7 | — | — | — | — | — | — | 7.59 | 116 | — |

*Compacting . . . zinc stearate 1%, graphite 0.4%, Compacting pressure 7 t/cm².
Temporary sintering . . . 875° C. × 20 min, Mold lubrication, Recompression pressure 7 t/cm².
**Regular Sintering . . . 1,250° C. × 60 min, Heat treatment: tempering in oil at 180° C. × 90 min after quenching from 850° C. into 60° C. oil.

In all of Examples 13–25 there were obtained recompressed densities above 7.40 g/cm³.

In Example 26 there was conducted a similar treatment to Examples 1–25 using fine powders of Ni, Mo and W. Although Example 26 is a little lower in recompressed density of Mo and W than in Example 24 of the same composition using oxide powders of Mo and W, there was obtained a high density above 7.40 g/cm³.

Table 6 shows recompressed densities of the steel powders used in Examples 27 to 30.

In all of the working examples, falling under the composition range specified herein, there were obtained recompressed densities above 7.40 g/cm³.

Comparative examples will be described below.

Water-atomized steel powders each containing chromium in the range of 0.05 to 7.5% and 0.6% of carbon were treated in a manner similar to Examples 1–25 to obtain Cr-prealloyed steel powders. Then, nickel and copper powders were incorporated in combination into the steel powders in such amounts as to give nickel and

TABLE 6

| Symbol | Amount of Alloy (%) Cr | V | Nb | Cu | Ni | Mo | W | Amount of Oxygen in Steel Powder (%) | Green Density (g/cm³) | Recompressed Density* (g/cm³) | Transverse rupture Strength of Heat-treated Compact** (kgf/mm²) | Alloying method |
|---|---|---|---|---|---|---|---|---|---|---|---|---|
| Example 27 | 4.5 | — | — | 0.2 | — | — | — | — | — | 7.43 | — | — |
| Example 28 | 4.5 | — | — | 5.0 | — | — | — | — | — | 7.43 | — | — |
| Example 29 | 4.5 | — | — | 9.5 | — | — | — | — | — | 7.41 | — | — |
| Example 30 | 4.5 | | | 1.2 | 3.8 | 1.0 | 1.0 | — | — | 7.44 | — | — |
| Comparative Example 14 | 4.5 | — | — | 12.0 | — | — | — | — | — | 7.36 | — | — |
| Comparative Example 15 | 4.5 | — | — | 3.0 | 5.0 | 2.0 | 2.0 | — | — | 7.38 | — | — |
| Comparative Example 16 | 2.5 | — | — | — | — | 2.5 | — | 0.81 | 6.78 | 6.89 | 105 | Composite alloying of Cr, Mo |
| Comparative Example 17 | 2.5 | — | — | — | — | 2.5 | — | 0.35 | 6.85 | 7.30 | 135 | Composite alloying of Cr, prealloying of Mo |

*Compacting . . . zinc stearate 1%, graphite 0.4%, Compacting pressure 7 t/cm².
Temporary Sintering . . . 875° C. × 20 min, Mold lubrication, Recompression pressure 7 t/cm².
**Regular Sintering . . . 1,250° C. × 60 min, Heat treatment: tempering in oil at 180° C. × 90 min after quenching from 850° C. into 60° C. oil.

copper contents in the final steel powders each in the range of 0 to 12.0%; also, molybdenum oxide and tungsten oxide powders were incorporated in combination into the steel powders in such amounts as to give molybdenum and tungsten contents in the final steel powders each in the range of 0 to 7.5%, followed by treatment in the same manner as in Examples 1-25. The thus-treated steel powders, as Comparative Examples 1-9, were subjected to compacting, temporary sintering, recompression, regular sintering and heat treatment in the same way as in Examples 1-25. With respect to each of Comparative Examples 1-3, the amount of oxygen in steel powder, green density, recompressed density and transverse rupture strength of the heat-treated compact are set forth in Table 1. In Comparative Example 1, with a Cr content of 0.05% below the lower limit, 0.1%, of Cr content specified herein, the strength after the heat treatment was insufficient and there was not obtained a transverse rupture strength above 170 kgf/mm$^2$, although the green density and recompressed density were high. In Comparative Example 2, since the Cr content of 7.5% was above the upper limit, 5.0%, of Cr content specified herein, the amount of oxygen in the steel powder exceeded 0.20% and there was obtained neither a green density above 7.0 g/cm$^3$ nor a recompressed density above 7.40 g/cm$^3$. Also in Comparative Example 3 the upper limit of Ni+Mo+W content was above the upper limit of 10.0%, there was obtained neither a green density above 7.0 g/cm$^3$ nor a recompressed density above 7.40 g/cm$^3$. In Comparative Example 4, because the Mo content was below the lower limit, 0.1%, of Mo content specified herein, the suppressing action of Mo for the diffusion of carbon into the Cr-containing steel powder was poor and there was not obtained a recompressed density above 7.40 g/cm$^3$. In Comparative Example 5, with an Mo content exceeding the upper limit, 5.0%, of Mo content specified herein, the recompressibility of the steel powder was deteriorated and there was not obtained a recompressed density above 7.40 g/cm$^3$. In all of Comparative Examples 6, 7, 8 and 9 there was not obtained a recompressed density above 7.40 g/cm$^3$ for the same reason as that mentioned in connection with Comparative Examples 5 and 6. In Comparative Example 10, a water-atomized steel powder containing 0.5% each of Cr, Ni and Mo and 0.6% of C was reduced in the same way as in Examples 1-25. However, since Ni and Mo in addition to Cr were all prealloyed, the diffusion suppressing action for carbon into the steel powder particles was not developed during sintering despite the same composition as in Example 21 and there was not obtained a recompressed density above 7.40 g/cm$^3$. Further, in each of Comparative Examples 11, 12 and 13, Ni and/or Mo was composite-alloyed with steel powder containing any of Nb, V and B in addition to Cr. In all of them, Nb, V and B were added in amounts exceeding the upper limit specified herein, so in comparison with Examples 14, 15 and 16, the heat-treated compacts were low in transverse rupture strength, not exceeding 170 kgf/mm$^2$. The values obtained were lower than that in Example 25 containing none of Nb, V and B.

In Comparative Example 14, Cu exceeded 10%, and in Comparative Example 15, Ni+Cu+Mo+W exceeded 10%. As a result, the recompressed density values obtained were both below 7.40 g/cm$^3$.

In Comparative Example 16, pure iron powder, Cr metal powder, Ni metal powder and Mo oxide powder were mixed together so as to obtain Cr and Mo contents in the final steel powder of 2.5% each. Thereafter, the mixture was treated in the same way as in Examples 1-25 to obtain steel powder. The steel powder thus obtained was subjected to compacting, temporary sintering, recompressing, regular sintering and heat treatment in the same manner as in Examples 1-25. Table 6 shows characteristics of the steel powder thus treated. The metal Cr is oxidized extremely easily and is difficult to be reduced with hydrogen, so it is oxidized with the Mo oxide added in the composite-alloying treatment. Consequently, the oxygen content of the steel powder, 0.81%, is a high value more than four times the value in Example 2 of the same composition. And on the surfaces of the steel powder particles the oxygen is present as a hard Cr oxide. As a result, the values of steel powder green density and recompressed density as well as deflective strength of the heat-treated compact were all markedly inferior as compared with Example 2.

In Comparative Example 17, Mo and Cr were alloyed by a prealloying process and a diffusive adhesion process, respectively, so as to obtain Cr and Mo contents in the final steel powder of 2.5% each. The steel powder thus obtained was subjected to compacting, temporary sintering, recompressing, regular sintering and heat treatment. Because of a high oxygen content of the steel powder there were obtained only low values of green density, recompressed density and transverse rupture strength of the heat-treated compact.

Thus, according to the present invention, an alloy steel powder superior in both compressibility and recompressibility can be obtained by adopting an alloying method which takes functions of alloy components into account and also by giving some consideration to the composition of alloy. Besides, by using such steel powder of the present invention it becomes possible to manufacture sintered parts for which high strength and high density are required. Further, also in point of economy the present invention is advantageous because it requires no special equipment other than the equipment in the conventional powder metallurgy.

What is claimed is:

1. An alloyed steel composite powder for powder metallurgy, having a diffused coating layer of at least one element selected from nickel, copper, molybdenum and tungsten, said diffused coating layer being partially diffused and adhered in a powder form to the surfaces of prealloyed steel powder particles containing chromium, the contents of said particles being in the following ranges:

Cr: 0.1-5.0 wt. %
Ni: 0.1-10.0 wt. %
Cu: 0.1-10.0 wt. %
Mo: 0.1-5.0 wt. %
W: 0.1-5.0 wt. % with the limitation that Ni+Cu+Mo+W is not more than 10.0 wt. %, and the balance comprising not more than 0.20 wt. % of oxygen and a substantial amount of iron.

2. An alloyed steel composite powder for powder metallurgy, having a diffused coating layer of at least one element selected from nickel, copper, molybdenum and tungsten, said diffused coating layer being partially diffused and adhered in a powder form to the surfaces of prealloyed steel powder particles containing chromium plus one of more elements selected from vanadium, niobium and boron, the contents of said particles being in the following ranges:

Cr: 0.1-5.0 wt. %

V: 0.01–0.5 wt. %
Nb: 0.001–0.1 wt. %
B: 0.0001–0.01 wt. %
Ni: 0.1–10.0 wt. %
Cu: 0.1–10.0 wt. %
Mo: 0.1–5.0 wt. %
W: 0.1–5.0 wt. % with the limitation that Ni+Cu+Mo+W is not more than 10.0 wt. %, and the balance comprising not more than 0.20 wt. % of oxygen and a substantial amount of iron.

* * * * *